US007231963B2

(12) United States Patent
Lee et al.

(10) Patent No.: US 7,231,963 B2
(45) Date of Patent: Jun. 19, 2007

(54) HEAT DISSIPATION DEVICE WITH INTERLOCKING FIN PLATES

(75) Inventors: Hsieh Kun Lee, Tu-Chen (TW); Cui Jun Lu, Shenzhen (CN); Ming Xian Sun, Shenzhen (CN)

(73) Assignees: Fu Zhun Precision Ind. (Shenzhen) Co., Ltd., Shenzhen (CN); Foxconn Technology Co., Ltd., Tu-Cheng (TW)

( * ) Notice: Subject to any disclaimer, the term of this patent is extended or adjusted under 35 U.S.C. 154(b) by 505 days.

(21) Appl. No.: 10/795,104

(22) Filed: Mar. 5, 2004

(65) Prior Publication Data

US 2004/0194928 A1 Oct. 7, 2004

(30) Foreign Application Priority Data

Mar. 5, 2003 (TW) ..... 92203298 U

(51) Int. Cl.
*H05K 7/20* (2006.01)

(52) U.S. Cl. ..... 165/104.33; 165/182

(58) Field of Classification Search ..... 165/104.33, 165/182

See application file for complete search history.

(56) References Cited

U.S. PATENT DOCUMENTS 2,307,355 A * 1/1943 Bredeson ..... 29/890.046
2,574,142 A * 11/1951 Buongirno ..... 165/77
2,726,850 A * 12/1955 Buongirno ..... 165/77
2,976,022 A * 3/1961 Gannon ..... 165/182
3,190,353 A * 6/1965 Storfer ..... 165/182
6,802,362 B2 * 10/2004 Wenger et al. ..... 165/80.3
2001/0042615 A1 * 11/2001 Moore et al. ..... 165/104.33

FOREIGN PATENT DOCUMENTS

| | | |
|---|---|---|
| CN | 2342407 Y | 10/1999 |
| CN | 2389343 Y | 7/2000 |
| CN | 2472435 Y | 1/2002 |
| CN | 2497431 Y | 6/2002 |
| TW | 480388 | 3/2002 |

* cited by examiner

*Primary Examiner*—Allen J. Flanigan
(74) *Attorney, Agent, or Firm*—Wei Te Chung

(57) ABSTRACT

A heat dissipation device includes a plurality of fin plates (1) and a pair of heat pipes (30). Each fin plate includes a first plate (10) and a second plate (20). The first plate forms a first fastener (15) at an edge thereof and a pair of cutouts (17) at opposite sides of the fastener. A pair of tabs (152) is formed at opposite sides of the first fastener and parallel to the first plate. The second plate forms a second fastener (25) at an edge thereof. The second fastener includes a pair of double-layer latches (252) received in the cutouts of the first plate and interengaged with the tabs of the first plate. The first fastener is located between the pair of latches. The heat pipes are inserted through the first and second plates between said edges. The first and second plates then abut each other at said edges.

17 Claims, 4 Drawing Sheets

HEAT DISSIPATION DEVICE WITH INTERLOCKING FIN PLATES

BACKGROUND OF THE INVENTION

1. Field of the Invention

The present invention relates to heat dissipation devices for removing heat from electronic components, and more particularly to a heat dissipation device including a plurality of individual fin plates that are interlocked together.

2. Description of Prior Art

Conventional heat dissipation devices used for removing heat from electronic components are mostly formed by extrusion of metallic material. This kind of heat dissipation device comprises a base, and a plurality of pins integrally extending from the base. The pins are relatively thick in comparison with distances defined between each two adjacent pins, due to inherent limitations in extrusion technology. This restricts the number of the pins that can be formed, and a total heat dissipation area that can be provided by the pins. Furthermore, a height of the pins is limited to about 13 times the distance between each two adjacent pins, also due to inherent limitations in extrusion technology.

With the continuing boom in electronics technology, numerous modern electronic components such as central processing units (CPUs) of computers can operate at very high speeds and thus generate large amounts of heat. The heat must be efficiently removed from the CPU; otherwise, abnormal operation or damage may result. Conventional extruded heat dissipation devices are increasingly no longer able to adequately remove heat from these contemporary electronic components.

In order to keep pace with these developments in the electronics technology, assembled heat dissipation devices have been gaining in popularity. For example, China Patent No. 2462641Y provides an assembled heat dissipation device having a plurality of uniformly dimensioned individual plate fins evenly stacked together. Each fin forms top and bottom flanges. Each flange defines a pair of indents in communication with a main body of the fin, and forms a pair of tabs extending from outer peripheries of the indents respectively. The tabs of each fin are attached on the corresponding flanges of an adjacent fin in the indents. Thus, all the fins are connected together to form the heat dissipation device. However, the fins are connected together only by the attachment of the tabs of each fin in the indents of the adjacent fin. The fins are prone to be disengaged from each other when the heat dissipation device is subjected to shock or vibration during transportation or in operation. Part of or even the entire stack of fins may collapse.

SUMMARY OF THE INVENTION

Accordingly, an object of the present invention is to provide a heat dissipation device including a plurality of individual fin plates that yields a relatively large total heat dissipation area.

Another object of the present invention is to provide a heat dissipation device including a plurality of individual fin plates attached together so that the heat dissipation device is stable and sturdy.

A further object of the present invention is to provide a heat dissipation device which includes a plurality of fin plates and heat pipes, the fin plates and the heat pipes being easily engaged with each other.

In order to achieve the objects set out above, a heat dissipation device in accordance with a preferred embodiment of the present invention comprises a plurality of individual fin plates and a pair of heat pipes coated with a layer of tin thereon. Each fin plate includes a first plate and a second plate. The first plate forms a first fastener at an edge thereof and a pair of cutouts at opposite sides of the fastener. A pair of tabs is formed at opposite sides of the first fastener and parallel to the first plate. The second plate forms a second fastener at an edge thereof. The second fastener includes a pair of double-layer latches received in the cutouts of the first plate. Each tab has its distal end received between a corresponding latch and the first fastener is sandwiched between the pair of latches. First and second semicircular slots defined in first and second plates respectively to cooperatively define a hole receiving the heat pipes therein. First and second flanges extend at extremities of the first and second slots from the first and second plate, for greater contact area with the heat pipes. After the heat pipes are inserted between the first and second plates, the first and second plates are caused to abut each other at said edges. After the layer of tin is melted, the heat pipes are thereby thermally connected to the fin plates between the first and second plates.

Other objects, advantages and novel features of the present invention will become more apparent from the following detailed description when taken in conjunction with the accompanying drawings, in which:

DETAILED DESCRIPTION OF THE INVENTION

Figure 1:
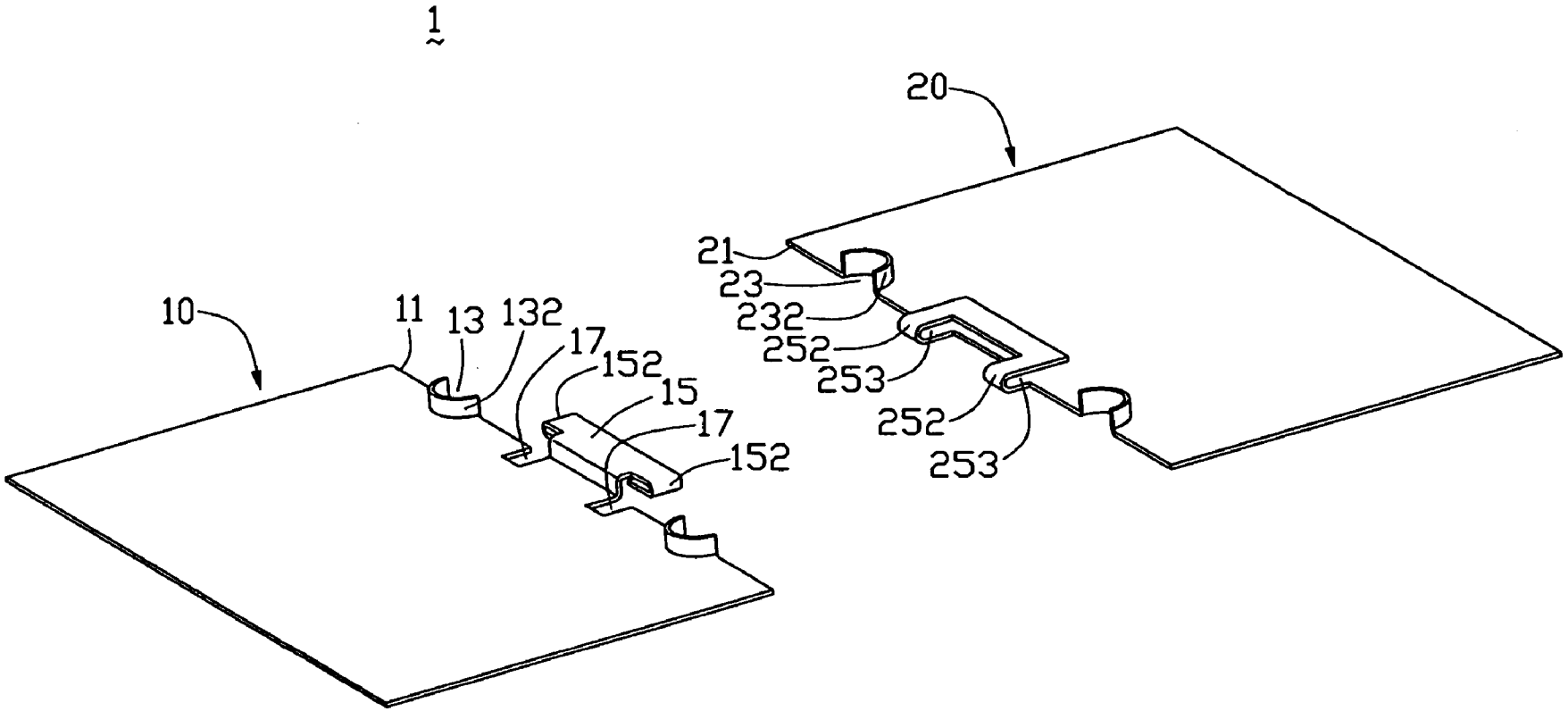
FIG. 1 is an exploded, isometric view of a fin plate of a heat dissipation device in accordance with the preferred embodiment of the present invention.

Referring to FIGS. 1–4, a heat dissipation device in accordance with the preferred embodiment of the present invention comprises a plurality of parallel fin plates 1, and a pair of heat pipes 30. Each fin plate 1 comprises a first plate 10 and a second plate 20 interlocked with each other. The first and second plates 10, 20 of the fin plates 1 surround the heat pipes 30 and are thermally connected therewith.

Referring to FIG. 1, each first plate 10 is metallic, and comprises a first engaging edge 11. A pair of semicylindrical first flanges 132 perpendicularly extends in a first direction from opposite sides of the first engaging edge 11 respectively, thereby defining a pair of semicylindrical first slots 13. The first flanges 132 are for providing large heat contact areas with the corresponding heat pipes 30. A first fastener 15 extends perpendicularly in the first direction from a middle of the first engaging edge 11, and then perpendicularly outwardly. A pair of U-shaped locking tabs 152 extends outwardly from opposite sides of a distal end of the first fastener 15 respectively, the locking tabs 152 being parallel to the first plate 10. A pair of cutouts 17 is defined at the first engaging edge 11, at opposite sides of the first fastener 15 respectively.

The second plate 20 is metallic, and comprises a second engaging edge 21. A pair of semicylindrical second flanges 232 perpendicularly extends in the first direction from opposite sides of the second engaging edge 21 respectively, thereby defining a pair of semicylindrical second slots 23. The second flanges 232 are for providing large heat contact areas with the corresponding heat pipes 30. A partly bifurcated second fastener 25 extends coplanarly outwardly from a middle of the second engaging edge 21, and then folds back over itself and an edge portion of the second plate 20. The second fastener 25 thus forms a pair of spaced U-shaped latches 252, the latches 252 defining a pair of aligned channels 253 therein respectively.

Figure 2:
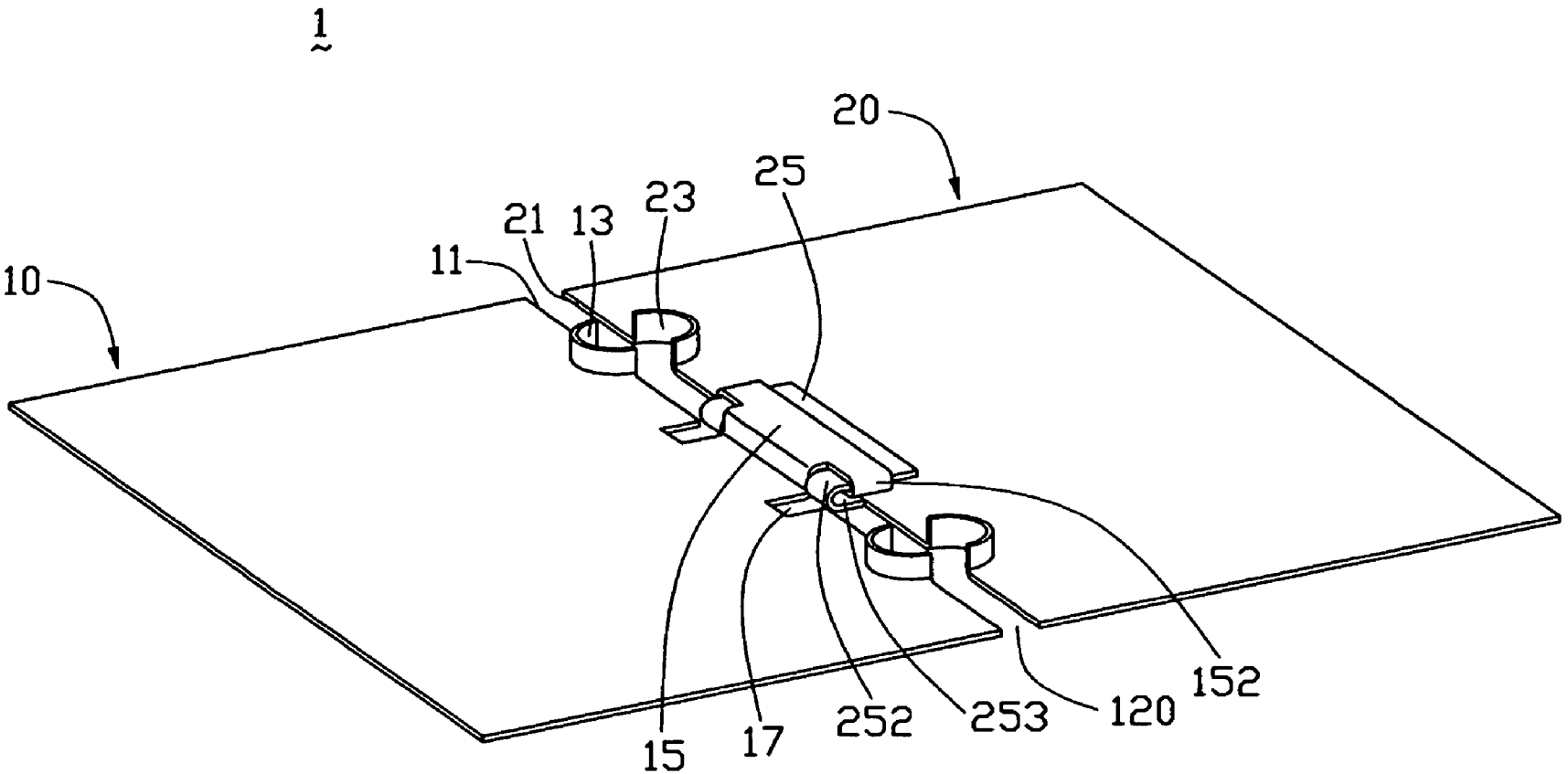
FIG. 2 is a pre-assembled view of the fin plate of FIG. 1.

FIG. 2 shows how each fin plate 1 is molded. Free end portions of the locking tabs 152 are located in the channels 253. That is, the locking tabs 152 are interengaged with the latches 252. The first and second engaging plates 10, 20 are coplanar, with a slit 120 defined between the first and second engaging edges 11, 21.

Figure 3:
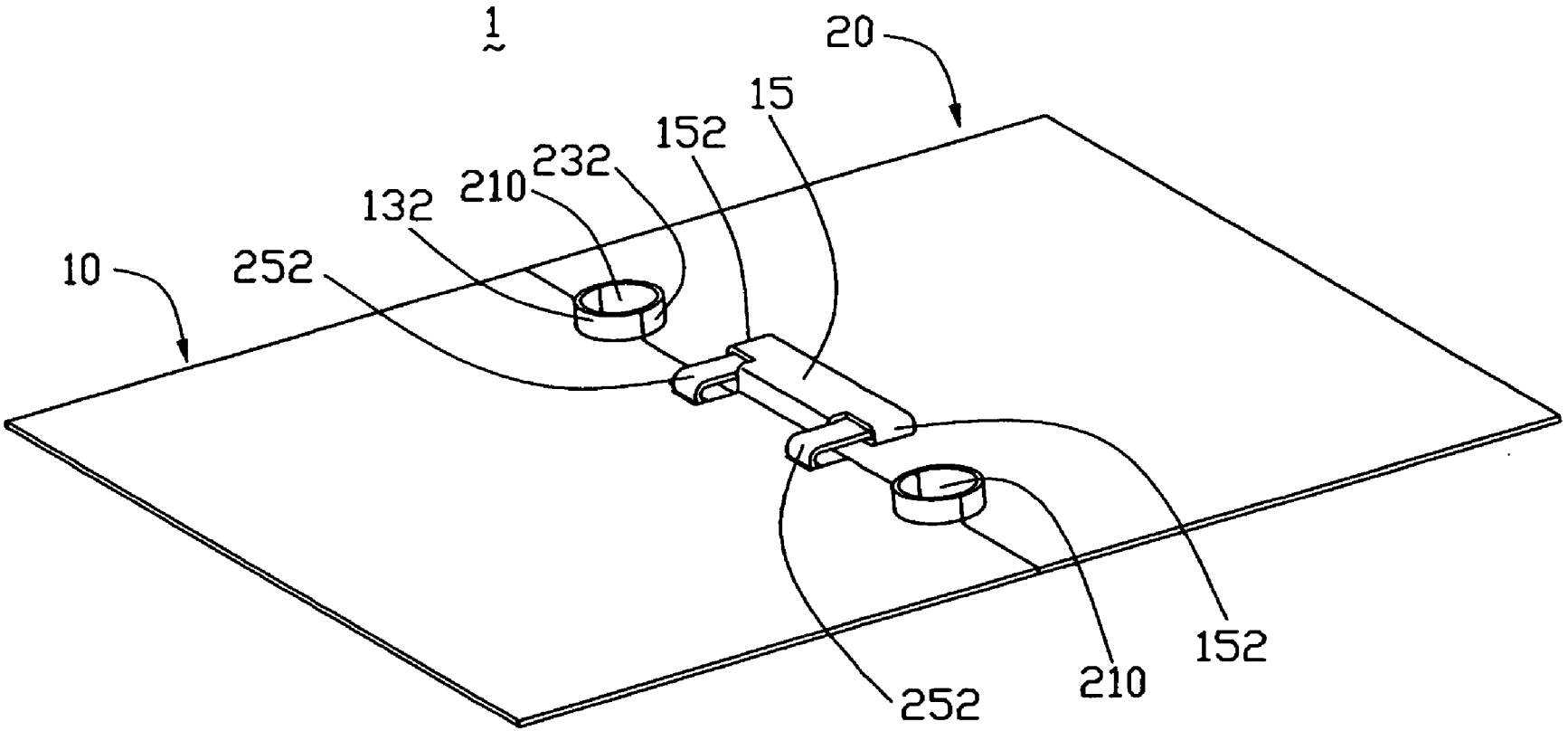
FIG. 3 is an assembled view of the fin plate of FIG. 2.

Referring to FIG. 3, when the first and second plates 10, 20 are pushed toward each other, the first fastener 15 slides relative to the second fastener 25, with the free end portions of the locking tabs 152 sliding in the channels 253 from the latches 252 of the second fastener 25 to the second plate 20. Finally, the first and second engaging edges 11, 21 abut each other. Each pair of corresponding first and second slots 13, 23 cooperatively defines a cylindrical hole 210. The flanges 132, 232 corresponding to each pair of the first and second slots 13, 23 cooperatively define a cylindrical tube perpendicular to the first and second plates 10, 20. The pair of cylindrical tubes receives corresponding heat pipes 30 therethrough. A portion of the first fastener 15 that adjoins the first plate 11 is located between the latches 252 of the second fastener 25. The latches 252 of the second fastener 25 are received in the cutouts 17 of the first plate 11.

Figure 4:
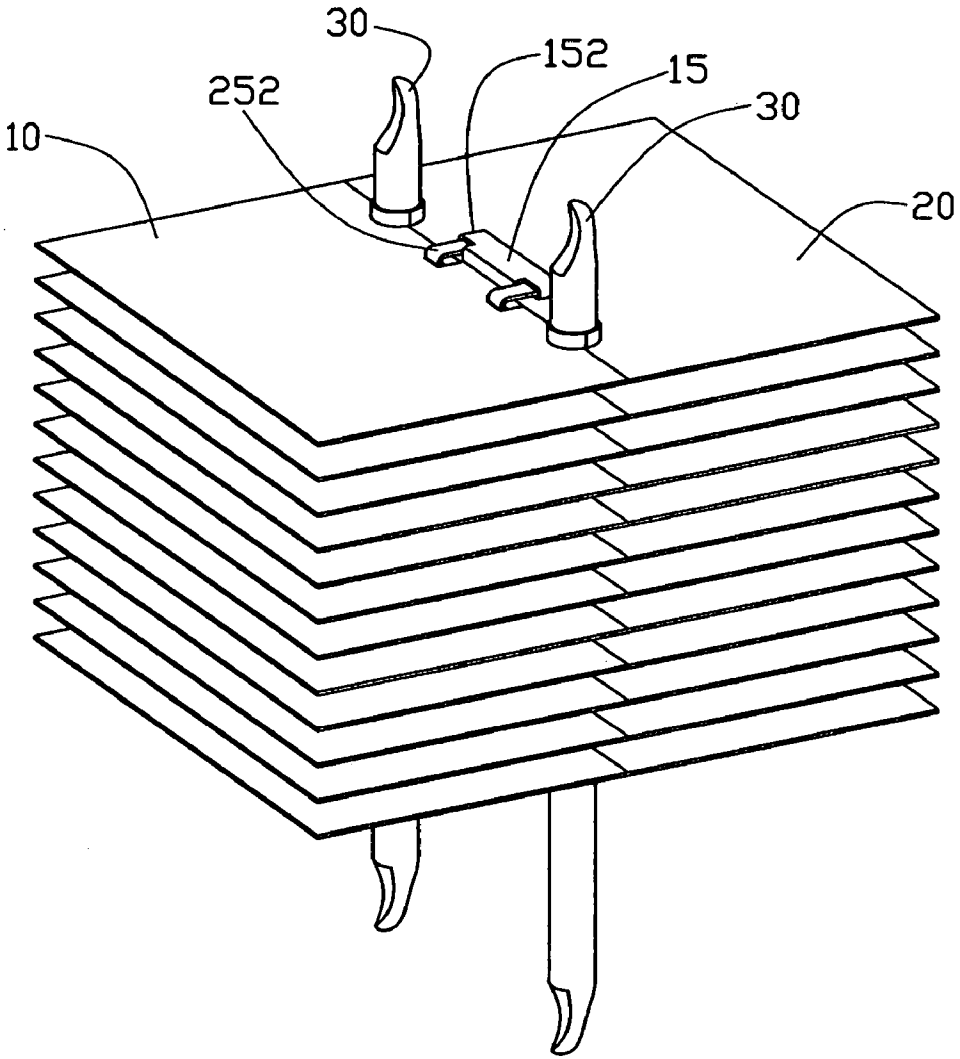
FIG. 4 is an isometric view of the heat dissipation device in accordance with the preferred embodiment of the present invention.

Referring to FIGS. 2 and 4, in assembly of the heat dissipation device, all the fin plates 1 are arranged parallel to each other in stack formation. Each heat pipe 30 is coated with a layer of tin (not shown). The heat pipes 30 are inserted through the corresponding first and second slots 13, 23 of the first and second plates 10, 20, such that the heat pipes 30 are not in contact with the first and second flanges 132, 232. The first and second plates 10, 20 are pushed toward each other until the first and second flanges 132, 232 abut the heat pipes 30. The layers of tin are melted, so that the heat pipes 30 and the fin plates 1 are thermally connected together. The heat dissipation device is thus formed, as shown in FIG. 4. A distance between any two adjacent fin plates 1 can be defined according to corresponding dimensions of the first and second flanges 132, 232, or according to corresponding dimensions of the first and second fasteners 15, 25.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A heat dissipation device comprising:

a plurality of individual fin plates, each of the fin plates comprising a first plate having a first fastener and a pair of cutouts, and a second plate being coplanar with the first plate and having a pair of generally U-shaped latches received in the cutouts of the first plate, the first fastener comprising a pair of locking tabs interengaged with the U-shaped latches respectively and sliding from the latches to the second plate whereby the first and second plates abut each other; and a heat pipe being secured between and perpendicular to the first and second plates of the fin plates.

2. The heat dissipation device of claim 1, wherein the cutouts are adjacent opposite sides of the first fastener.

3. The heat dissipation device of claim 1, wherein the second plate comprises a second fastener corresponding to the first fastener of the first plate, the U-shaped latches being provided in the second fastener.

4. The heat dissipation device of claim 1, wherein a portion of the first fastener that adjoins the first plate is located between the U-shaped latches.

5. The heat dissipation device of claim 1, wherein the locking tabs are generally U-shaped, and extend outwardly from opposite sides of a distal end of the first fastener.

6. The heat dissipation device of claim 1, wherein the locking tabs are substantially parallel to the first plate.

7. The heat dissipation device of claim 3, wherein a semicylindrical first flange extends from the first plate and a semicylindrical second flange extends from the second plate, for providing large contact areas between the first and second plates and the heat pipe.

8. The heat dissipation device of claim 7, wherein a distance between any two adjacent fin plates is defined according to dimensions of the first and second flanges and/or according to dimensions of the first and second fasteners.

9. The heat dissipation device of claim 1, wherein the heat pipe is coated with a layer of tin.

10. A fin plate comprising:

a first plate comprising a first fastener at an edge thereof and a pair of cutouts at opposite sides of the first fastener, the first fastener having a pair of tabs at opposite sides thereof; and a second plate being coplanar with the first plate and comprising a second fastener at an edge thereof, the second fastener having a pair of double-layer latches received in the cutouts of the first plate; wherein the tabs are interengaged with the second fastener and the first fastener is located between the pair of latches, the first plate and the second plate thereby abutting each other at said edges.

11. The fin plate of claim 10, wherein a first flange extends from the first plate at said edge thereof, a second flange extends from the second plate at said edge thereof, and the first and second flanges cooperatively define a cylindrical tube perpendicular to the first and second plates.

12. The fin plate of claim 10, wherein the tabs are generally U-shaped.

13. The fin plate of claim 10, wherein the first fastener is slidable relative to the second fastener.

14. The fin plate of claim 10, wherein the latches extend coplanarly outwardly from said edge of the second plate and then fold back over themselves.

15. A heat dissipation device comprising:

a plurality of parallel fin plates, each of said fin plates including two opposite half portions defining opposite abutment edges abutting against each other;

semi-circular notches formed in the opposite edges for commonly define a circular hole;

interengaging device formed on the opposite edges to allow said two half portions to not only guidably move toward and until abutting against each other during assembling but also to prevent relative movement between the half portions in at least two directions perpendicular to each other; and a heat pipe extending through said circular hole;

wherein the interengaging device comprises a first fastener at one of the opposite half portions and a pair of U-shaped latches at the other of the opposite half portions, the first fastener having a pair of locking tabs located at opposite sides thereof and received in the U-shaped latches.

16. The heat dissipation device of claimed in claim 15, wherein the U-shaped latches define a pair of channels and free end portions of the locking tabs are received in the channels.

17. The heat dissipation device of claimed in claim 16, wherein the interengaging device further comprises a pair of cutouts at opposite sides of the first fastener to receive the U-shaped latches therein.

* * * * *